US008084726B2

(12) United States Patent
Hanlon et al.

(10) Patent No.: US 8,084,726 B2
(45) Date of Patent: Dec. 27, 2011

(54) CONTROL SYSTEM FOR AN EXOATMOSPHERIC KILL VEHICLE

(75) Inventors: J. Casey Hanlon, Queen Creek, AZ (US); Pablo Bandera, Goodyear, AZ (US)

(73) Assignee: Honeywell International, Inc., Morristown, NJ (US)

( * ) Notice: Subject to any disclaimer, the term of this patent is extended or adjusted under 35 U.S.C. 154(b) by 355 days.

(21) Appl. No.: 12/200,774

(22) Filed: Aug. 28, 2008

(65) Prior Publication Data

US 2010/0282892 A1 Nov. 11, 2010

(51) Int. Cl.
*F42B 15/01* (2006.01)
*F41G 7/00* (2006.01)
*F42B 15/00* (2006.01)

(52) U.S. Cl. ..... 244/3.22; 244/3.1; 244/3.15; 244/3.21; 89/1.11

(58) Field of Classification Search ..... 244/3.1–3.3; 89/1.11; 60/200.1, 224, 225, 233, 243; 251/129.01–129.22; 137/1, 13, 14, 82–86
See application file for complete search history.

(56) References Cited

U.S. PATENT DOCUMENTS 2,965,334 A * 12/1960 McCullough, Jr. et al. . 244/3.22
3,708,139 A * 1/1973 Wheeler ..... 244/3.13
3,710,086 A * 1/1973 Lahde et al. ..... 244/3.1
3,726,496 A * 4/1973 Leonard ..... 244/3.22
4,413,795 A * 11/1983 Ryan ..... 244/3.22
4,428,188 A * 1/1984 Turansky et al. ..... 60/225
4,659,036 A * 4/1987 Pinson ..... 244/3.22
4,684,080 A * 8/1987 Pinson ..... 244/3.22
4,826,104 A * 5/1989 Bennett et al. ..... 244/3.22
5,004,079 A 4/1991 Ivers et al.
5,103,636 A * 4/1992 Bak ..... 60/243
5,465,757 A 11/1995 Peters
5,787,924 A 8/1998 Cewers et al.
5,788,180 A * 8/1998 Sallee et al. ..... 244/3.21
6,092,782 A 7/2000 Yamada et al.
6,200,100 B1 3/2001 Yang et al.
6,427,970 B1 8/2002 Silva
6,554,248 B2 4/2003 Taniguchi et al.
6,722,625 B2 4/2004 Blomberg et al.
6,886,801 B2 5/2005 Hallback et al.
7,073,771 B2 7/2006 Shajii et al.
7,163,176 B1 * 1/2007 Geswender et al. ..... 244/3.27
7,323,960 B2 1/2008 Maruyama
2002/0158218 A1 10/2002 Fuwa
2005/0092952 A1 5/2005 McCarroll et al.
2008/0119963 A1 5/2008 LaPlante et al.

* cited by examiner

*Primary Examiner* — Bernarr E Gregory
(74) *Attorney, Agent, or Firm* — Ingrassia Fisher & Lorenz

(57) ABSTRACT

A control system for a maneuverable kill vehicle is provided. The control system includes a pressurized fluid source configured to provide a pressurized fluid, a valve in fluid communication with the pressurized fluid source, and a voice coil actuator comprising a magnet and a conductive coil oriented relative to the magnet such that when current flows through the coil, the coil moves relative to the magnet. The voice coil actuator is coupled to the valve such that the relative movement of the coil causes an adjustment in a flow rate of the pressurized fluid through the valve.

20 Claims, 6 Drawing Sheets

CONTROL SYSTEM FOR AN EXOATMOSPHERIC KILL VEHICLE

TECHNICAL FIELD

The present invention generally relates to exoatmospheric kill vehicles, and more particularly relates to a control system for an exoatmospheric kill vehicle.

BACKGROUND

Missile defense systems have been under development by the world's leading military powers since the latter part of the $20^{th}$ century. One category of such defense systems is designed to target and intercept strategic missiles, such as intercontinental ballistic missiles (ICBMs), often in exoatmospheric environments (i.e., very high altitudes).

One method for disabling such an object involves ramming a payload into it without making use of any explosive devices (i.e., using only the force of impact). These payloads are sometimes referred to as "exoatmospheric kill vehicles (EKVs)" or "kinetic kill vehicles (KKVs)" and are typically deployed by ground-based missile systems. Once deployed, EKVs may utilize on-board sensors and electrical systems, in combination with multiple sets of thrusters, to both stabilize the kill vehicle and to alter the trajectory thereof. Due to the high speeds at which the EKV and the target are traveling (e.g., several miles per second), maintaining precise control of the vehicle is essential.

Accordingly, it is desirable to provide an improved control system for an EKV (or other maneuverable kill vehicle). Furthermore, other desirable features and characteristics of the present invention will become apparent from the subsequent detailed description of the invention and the appended claims, taken in conjunction with the accompanying drawings and this background of the invention.

BRIEF SUMMARY

A control system for a maneuverable kill vehicle is provided. The control system includes a pressurized fluid source configured to provide a pressurized fluid, a valve in fluid communication with the pressurized fluid source, and a voice coil actuator comprising a magnet and a conductive coil oriented relative to the magnet such that when current flows through the coil, the coil moves relative to the magnet, wherein the voice coil actuator is coupled to the valve such that said relative movement of the coil causes an adjustment in a flow rate of the pressurized fluid through the valve.

A control system for a maneuverable kill vehicle is provided. The control system includes a pressurized fluid source configured to provide a pressurized fluid, a valve in fluid communication with the pressurized fluid source, and a voice coil actuator. The voice coil actuator includes a magnet assembly having first and second magnets, each having first and second poles, and being arranged such that the first poles of the first and second magnets are positioned substantially between the second poles of the first and second magnets, and first and second conductive coil portions oriented relative to the magnet assembly such that when current flows through the coil portions, the coil portions move relative to the magnet assembly. The voice coil is coupled to the valve such that said relative movement of the coil portions causes an adjustment in a flow rate of the pressurized fluid through the valve.

A maneuverable kill vehicle is provided. The maneuverable kill vehicle includes a frame, a pressurized fluid source connected to the frame configured to provide a pressurized fluid, a plurality of valves in fluid communication with the pressurized fluid source, a plurality of voice coil actuators, each comprising a magnet and a conductive coil oriented relative to the magnet such that when current flows through the coil, the coil moves relative to the magnet, wherein each of the voice coil actuators is coupled to a respective valve such that the relative movement of the coil causes an adjustment in a flow rate of the pressurized fluid through the respective valve, and a controller in operable communication with the voice coil actuators and configured to selectively cause the current to flow through the coils of the voice coil actuators.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, and brief summary or the following detailed description. It should also be noted that FIGS. 1-7 are merely illustrative and may not be drawn to scale.

FIG. 1 to FIG. 7 illustrate a control system for a maneuverable kill vehicle. The control system includes a pressurized fluid source configured to provide a pressurized fluid, a valve in fluid communication with the pressurized fluid source, and a voice coil actuator comprising a magnet and a conductive coil oriented relative to the magnet such that when current flows through the coil, the coil moves relative to the magnet. The voice coil actuator is coupled to the valve such that said relative movement of the coil causes an adjustment in a flow rate of the pressurized fluid through the valve.

Figure 1:
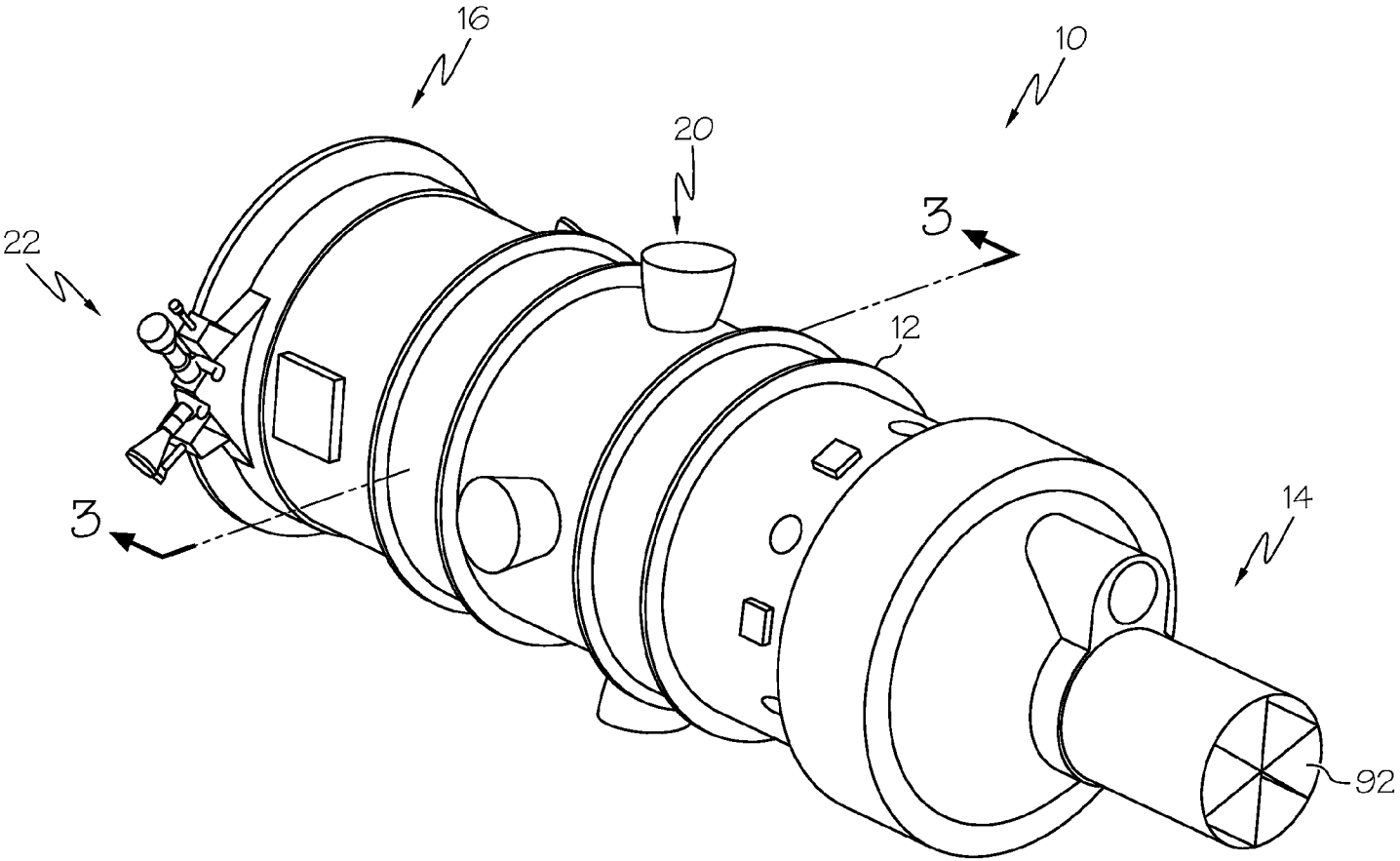
FIG. 1 is an isometric view of an exoatmospheric kill vehicle (EKV), according to one embodiment of the present invention.
Figure 2:
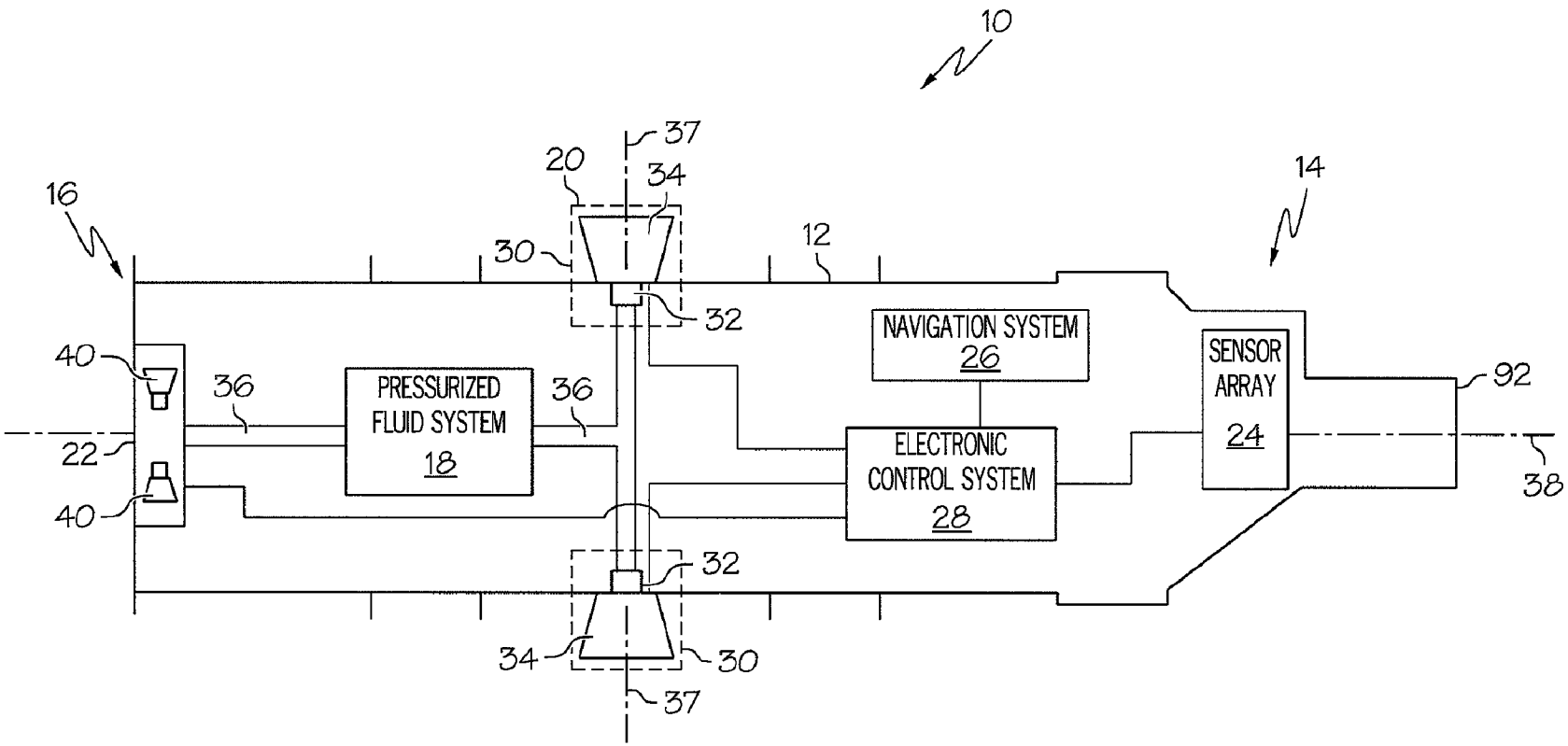
FIG. 2 is a cross-sectional schematic block diagram of the vehicle of FIG. 1.

FIGS. 1 and 2 illustrate a maneuverable kill vehicle (e.g., an exoatmospheric kill vehicle (EKV) or a kinetic kill vehicle (KKV)) 10, according to one embodiment of the present invention. The vehicle 10 includes a body (or frame) 12 with a forward end 14 and an aft end 16. Housed within the body 12 are a pressurized fluid system 18, a divert thruster system 20, an attitude and control thruster system (ACS) 22, a sensor array 24, a navigation system 26, and an electronic control system 28.

The pressurized fluid system 18 is located near a central portion of the body 12 and is configured to provide a pressurized fluid to the divert and ACS thruster systems 20 and 22. In one embodiment, the pressurized fluid system 18 includes a solid propellant gas generator (e.g., a solid rocket fuel or propellant engine). In another embodiment, the fluid system includes a container of an inert, pressurized gas, such as nitrogen. Although shown in FIG. 1, and perhaps referred to as a single system (or source), the pressurized fluid system 18 may include two, separate pressurized fluid sources for the divert thruster system 20 and the ACS 22.

The divert thruster system 20 is located near the central portion of the body 12 and includes four divert thruster assemblies 30, located at respective top, bottom, and lateral sides of the body 12. Each of the thruster assemblies include a divert thruster valve 32 and a divert thruster nozzle 34. The divert thruster valves 32 are in fluid communication with the fluid source 18 through an array of fluid conduits 36 and are operable between "open" and "closed" modes to control the flow of the pressurized fluid through the divert nozzle thruster nozzles 34 to the exterior of the vehicle 10. The divert thruster nozzles 34 are arranged such that central axes 37 thereof are substantially perpendicular to and intersect a primary axis 38 of the body 12 (e.g., a roll axis of the vehicle 10).

Figure 3:
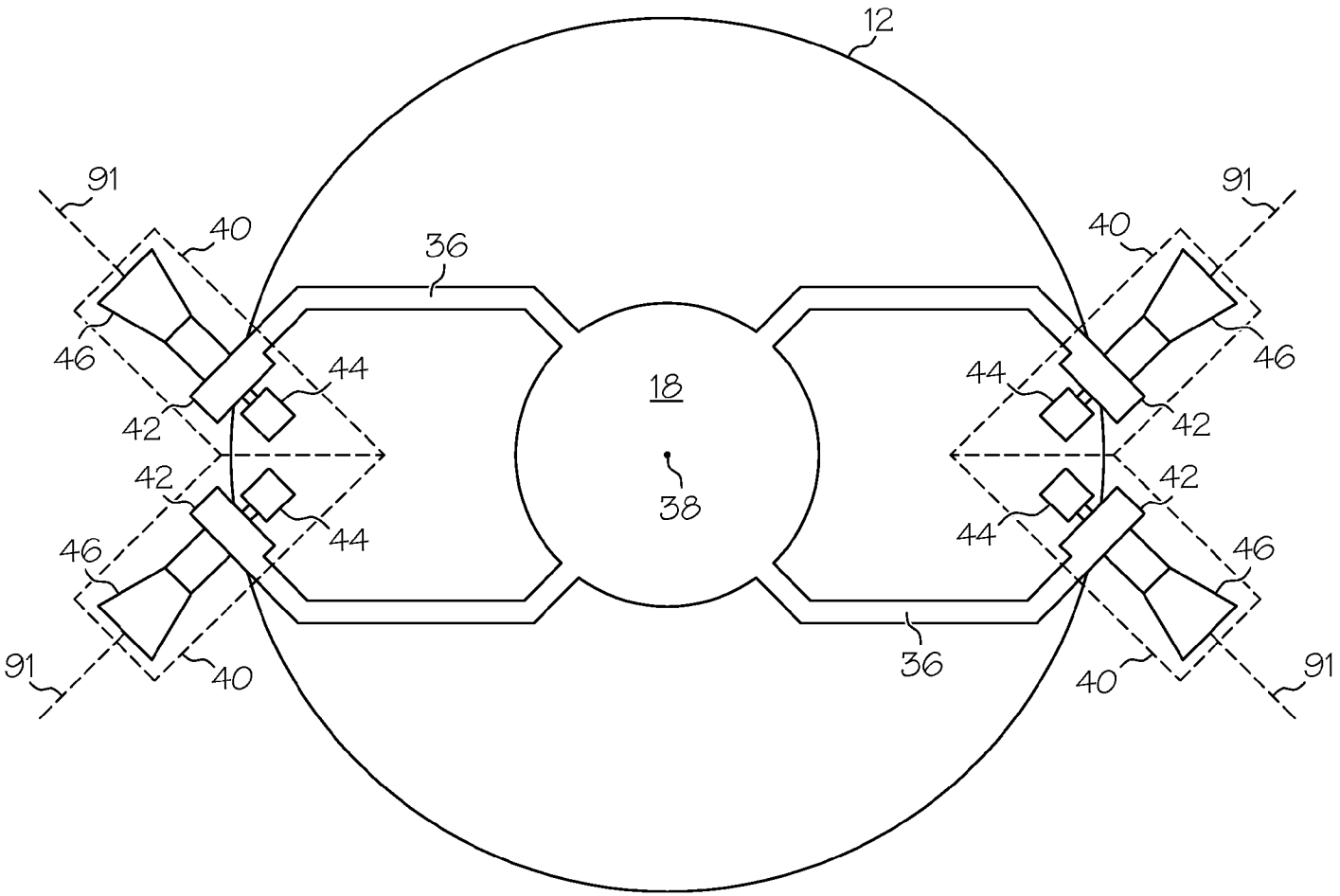
FIG. 3 is a cross-sectional schematic view of the vehicle of FIG. 1 taken along line 3-3.
Figure 5:
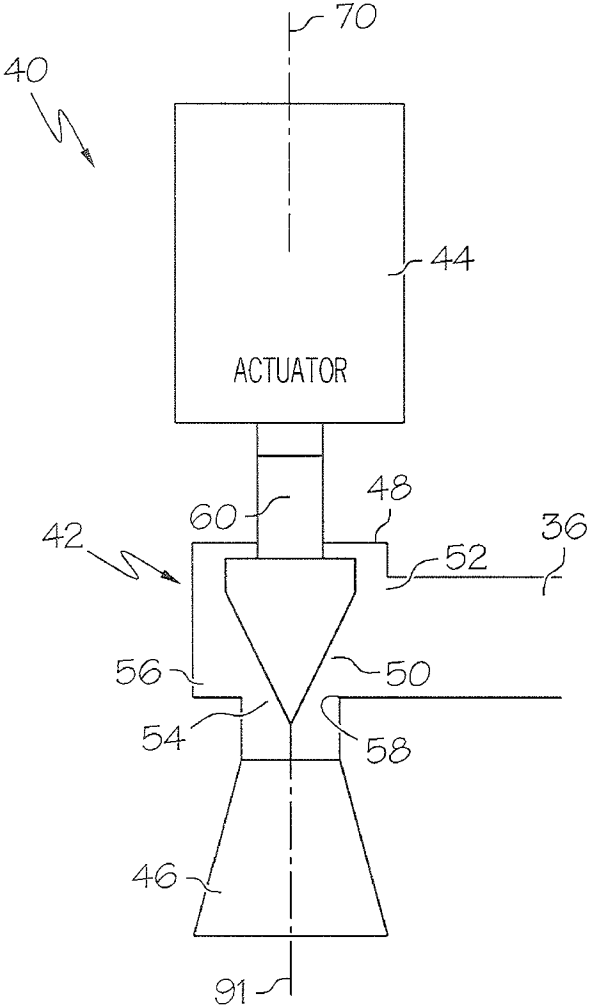
FIGS. 4 and 5 are schematic views of a thruster assembly within the vehicle of FIG. 1.
Figure 4:
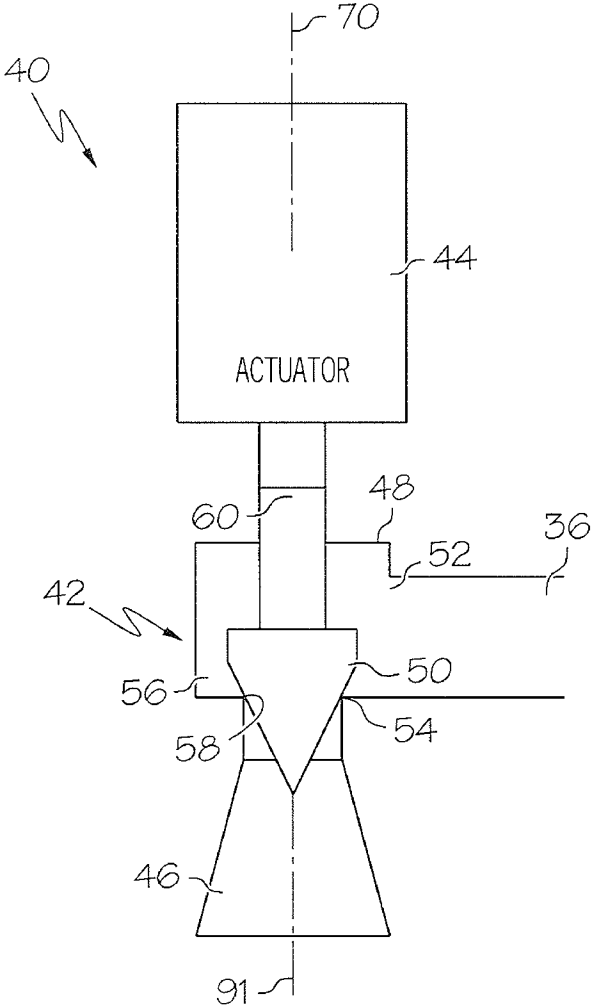

Referring now to FIGS. 2, 3 and 4, the ACS thruster system 22 is located near the aft end 16 of the body 12 and includes four ACS thruster assemblies 40. Each of the stabilizer thruster assemblies 40 includes an ACS thruster valve 42, an ACS thruster actuator 44, and an ACS thruster nozzle 46. The ACS thruster valves 42 each include a valve body 48 and a valve member 50. The valve body 48 includes an inlet port 52, an outlet port 54, and a passageway 56 therethrough that interconnects the ports 52 and 54. The valve body 48 (of each assembly 40) is in fluid communication with the fluid source 18 through the fluid conduits 36. Referring specifically to FIGS. 4 and 5, the valve member 50 is moveable within the passageway 56 between first and second positions. As shown in FIG. 4, in the first position, the valve member 50 blocks the flow of fluid through the valve body 48 by mating with an inner edge 58 of the outlet port 54. In the second position, as shown in FIG. 5, the valve member 50 is pulled away from the outlet port 54 so that fluid may pass through the valve body 48. The valve member 50 and/or the valve body 48 may be sized such that the valve member 50 has a relatively small clearance within the passageway 56, such as between 0.010 and 0.020 inches. The valve member 50 is connected to the ACS thruster actuator 44 through a shaft 60. Although perhaps not drawn to scale, it should be understood that in at least one embodiment, the ACS thruster valves 42 are "pintle valves," as is commonly understood. As such, in the depicted embodiment, the valve member 52 is in the shape of a "pintle" (e.g., a pin or needle) and has a tapered shaped such that when in the first position, the valve member 52 extends through the outlet port 54 as shown in FIG. 4.

Figure 6:
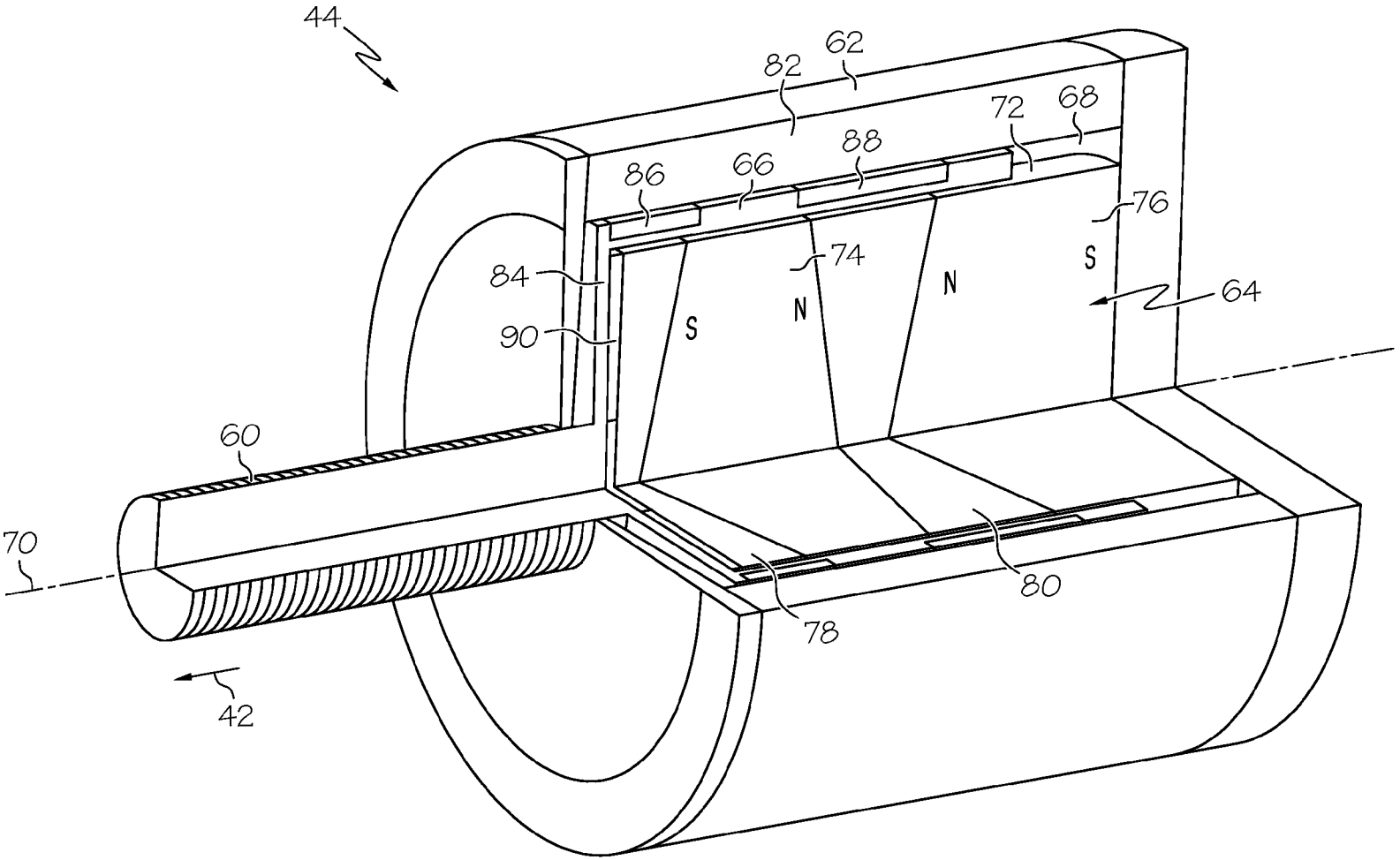
FIG. 6 is a sectioned isometric view of an actuator within the thruster assembly of FIGS. 4 and 5.
Figure 7:
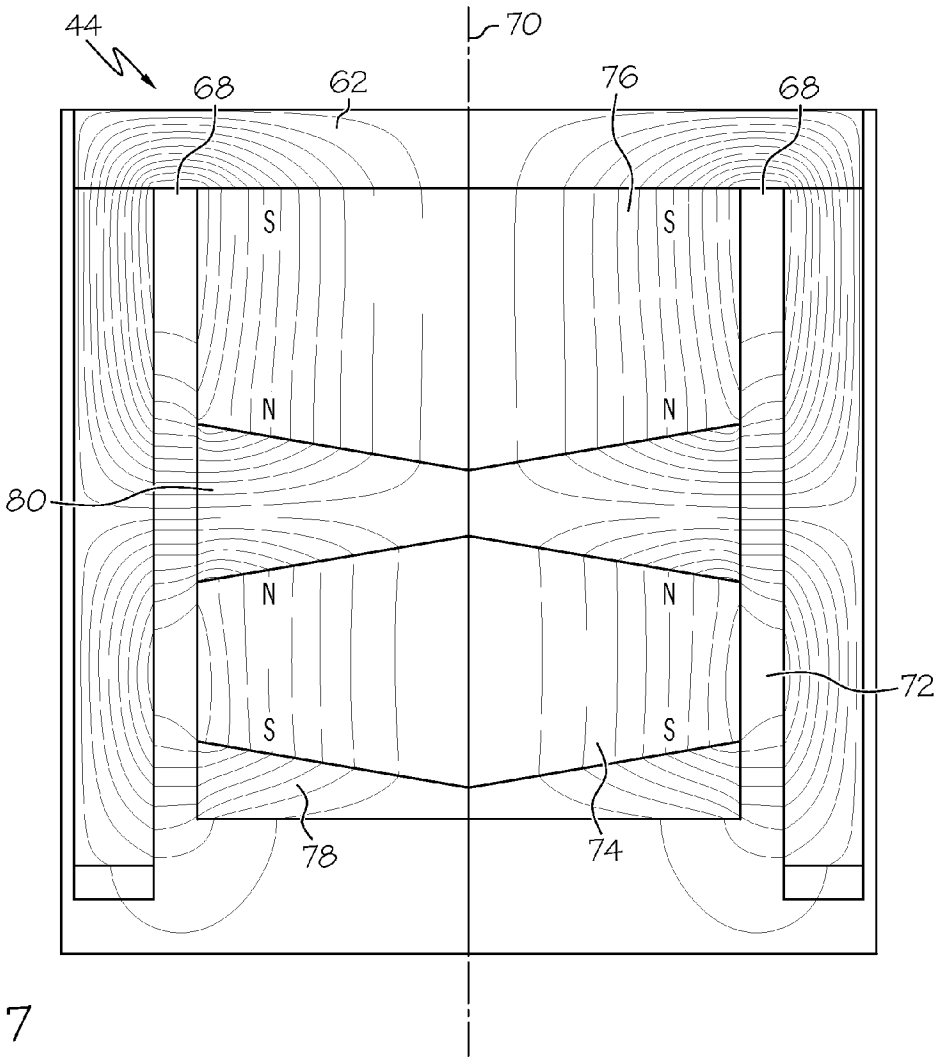
FIG. 7 is a cross-sectional side view of a casing and a magnet assembly within the actuator of FIG. 6 illustrating magnetic flux passing therethrough.

FIGS. 6 and 7 illustrate one of the ACS thruster actuators 44, according to one embodiment of the present invention. In one embodiment, the actuator is a voice coil actuator and includes a casing 62, a magnet assembly 64, and a bobbin 66. In the depicted embodiment, the casing 62 is cylindrical, is symmetric about an actuator axis 70, and encloses a chamber 68. The casing 62 may be made of a ferromagnetic material, such as iron and/or steel.

The magnet assembly 64 is connected to the casing 62 at one end thereof and is sized such that a gap 72 lies between a remainder of the magnet assembly 64, including a periphery thereof and the opposing end. The magnet assembly 64 includes first and second magnets 74 and 76 and first and second ferromagnetic members 78 and 80, all of which are symmetric about the actuator axis 70. The first and second magnets 74 and 76 are substantially in the shape of a disc and have a thickness (as measured along the actuator axis 70) that decreases as the magnets 74 and 76 extend away from the actuator axis 70. As such, a distance between the first and second magnets 74 and 76 increases with distance from the actuator axis 70. The magnets 74 and 76 each have first (N) and second (S) poles and are arranged such that the second poles (S) of the two magnets 74 and 76 lie on opposing sides of the first poles (N). That is, in the depicted embodiment, the first poles (N) of the magnets 74 and 76 "face" each other. It should be understood however that in other embodiments the magnets 74 and 76 may be arranged differently, such as by having the second poles (S) positioned between the first poles (N).

The ferromagnetic members 78 and 80 are also disc-shaped but have a thickness that increases as the ferromagnetic members 78 and 80 extend away from the axis. As such, a distance between the first and second ferromagnetic members 78 and 80 decreases with distance from the actuator axis 70. As shown in FIGS. 6 and 7, the members 78 and 80 are positioned on opposing sides of the first magnet 74, and the second member 80 is positioned between the first and second magnets 74 and 76. Similar to the casing 62, the first and second ferromagnetic members 78 and 80 may be made of, for example, iron and/or steel.

As illustrated specifically in FIG. 7, magnetic flux from the first and second magnets 74 and 76 may be understood to emanate from the first poles (N) of the magnets 74 and 76 into the second ferromagnetic member 80. Due in part to the shape of the magnets 74 and 76, the flux is then directed away from the actuator axis 70 and crosses the gap 72. Continuing away from the actuator axis 70, the flux enters the casing 62, where the flux from each magnet 74 and 76 passes through the casing 62 towards its respective second pole (S). After crossing the air gap 72, the flux then re-enters the magnets 74 and 76 at the second poles (S) as shown, thus completing a magnetic circuit.

Referring again to FIG. 6, the bobbin 66 is a cylindrically-shaped non-magnetic member having a sidewall 82 and an end portion 84 and is positioned within the gap 72. The sidewall 82 includes a first conductive coil (or coil portion) 86 and a second conductive coil (or coil portion) 88, which both include electrically conductive wire made of, for example, copper and/or gold. Although not specifically shown, the conductive wire within the first coil portion 86 is wound about the actuator axis 70 in a first direction (e.g., clockwise), and the conductive wire within the second coil portion 88 is wound about the actuator axis 70 in a second direction (e.g., counterclockwise). The end portion 84 of the bobbin 66 is connected to the shaft 60.

Still referring to FIG. 6, the actuator 44 also includes a spring (or flexure) member 90, such as a Belleville washer, between the magnet assembly 64 and the end portion 84 of the bobbin 66 that applies a force on the bobbin 66 towards the valve 42 (i.e., to pre-load the bobbin 66 towards the valve 42).

As shown in FIGS. 3-5, the ACS thruster nozzles 46 are in fluid communication with the outlet ports 54 of the valve bodies 48 within the ACS thruster valves 42. Each of the nozzles 46 are symmetric about a respective ACS axis 91, which is orthogonal to, and does not intersect, the primary axis 38 of the vehicle 10. In one embodiment, the ACS axis 91 of each assembly 40 is congruent with the actuator axis 70 of the respective actuator 44, and both axes 70 and 91 extend through the valve member 50 and the outlet port 54.

Referring again to FIG. 2, the sensor array 24 is located near the forward end 14 of the body 12, and although not specifically shown, includes multiple electromagnetic sensors, such as optical and infrared sensors, that are directed (i.e., aimed) through an opening 92 at the forward end 14 of the body 12.

Although not specifically shown, the navigation system 26 includes multiple gyroscopes and accelerometers configured to detect changes in angular orientation and acceleration, respectively, in three dimensions. The navigation system 26 also includes one of more receivers for receiving data (e.g., commands and positional data) from various sources, such as ground-based and satellite-based transmitters.

The electronic control system (or controller) 28 may be in the form of a computer, or computing system, having a memory (i.e., computer-readable medium) for storing a set of instructions (i.e., software) and a processing system, including various circuitry and/or integrated circuits, such as field programmable gate arrays (FPGAs), application specific integrated circuits (ASICs), discrete logic, microprocessors, microcontrollers, and digital signal processors (DSPs), connected to the memory for executing the instructions, as is commonly understood in the art. The instructions stored within the control system 28 may include the methods and processes for controlling the vehicle 10 as described below. Although not shown, the electronic control system 28 includes a power supply, which may be any one of various types of variable direct current (DC) power supplies. The electronic control system 28 (and/or the power supply) is electrically connected to, or in operable communication with, the divert thruster valves 32 (i.e., the actuators contained therein), the ACS thruster actuators 44 (i.e., the first and second coil portions 86 and 88), the sensor array 24, and the navigation system 26.

Although not shown, the vehicle 10 may also include a propulsion thruster and associated valve at the aft end thereof, which is in fluid communication with the pressurized fluid supply 18.

In operation, the vehicle 10 may be deployed into an exoatmospheric environment by a suitable delivery system (e.g., a rocket). Once deployed, the vehicle 10 receives data and commands through the navigation system 26, which the electronic control system 28 uses to selectively activate the divert and ACS thruster systems 20 and 22. When activated, the divert thruster assemblies 30 cause the pressurized fluid to be evacuated from the vehicle 10, typically in relative short bursts. The divert thruster assemblies 30 are configured such that the bursts of fluid therefrom cause a relative large force to be applied to the vehicle 10 to adjust the trajectory of the vehicle 10.

In response to slight, undesired variations in the trajectory of the vehicle 10 (e.g., as detected by the gyroscopes and accelerometers in the navigation system 26), the electronic control system 28 may selectively activate the ACS thruster assemblies 40 as described to stabilize the vehicle 10 (e.g., stop the vehicle 10 from tumbling and/or spinning, as well as orientate it such that it is pointed towards the desired target).

Referring to FIGS. 1 and 6, the electronic control system 28 (or the power supply therein) causes a current to flow through the first and second coil portions 86 and 88. Due to the opposing directions in which the conductive wire is wound, the current flows through the first and second coil portions 86 and 88 in opposing directions around the actuator axis 70. As the current flows through the magnetic flux generated by the first and second magnets 74 and 76, a Lorentz force opposing the force of the spring member 90 is generated and applied to the bobbin 66, causing the bobbin 66 to move away from the stabilizer thruster valve 42. As the amount of current is increased, the bobbin 66 moves farther from the valve 42. In one embodiment, the components of the actuator 44 are sized such that the maximum distance the bobbin 66 may move is between 0.0010 and 0.0020 inches.

Referring now to FIGS. 5 and 6, because of the connection between the bobbin 66 and the valve member 50 through the shaft 60, as the bobbin 66 moves, the valve member 50 is pulled away from the outlet port 54 of the valve body 48. Because of the direct connection between the bobbin 66 and the valve member 50, the two components move at the same speed and in parallel directions.

As a result, pressurized fluid is allowed to pass through the valve body 48 and be evacuated through the ACS thruster nozzle 46. The ACS thruster assemblies 40 (and the associated pressurized fluid source) are configured such that the bursts of fluid therefrom cause relatively small force to be applied to the vehicle 10 to make slight adjustments to and stabilize the vehicle 10. When the control system 28 deactivates the flow of current through the coil portions 86 and 88, the spring member 90 presses the bobbin 66 back into the pre-loaded position, and thus the valve member 50 returns to the first position, as shown in FIG. 1, to close the valve 42. Referring to FIG. 3, as is commonly understood, different combinations of the ACS thruster assemblies 40 may be simultaneously activated to stabilize the vehicle 10.

One advantage of the control system described above is that the valve member is in a fixed position relative to the moveable portion (e.g., the bobbin) of the actuator. This, when combined with the fact that the valve member moves only a small distance (e.g., several thousandths of an inch) within the valve body, results in extremely precise control of the ACS thruster assemblies (particularly when used with a pintle valve). Additionally, the lack any sort of gearing assembly between the bobbin and the valve member eliminates backlash and compliance from the system, thereby improving position control and system reliability and reducing the cost of the vehicle.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A control system for a maneuverable kill vehicle comprising:

a pressurized fluid source configured to provide a pressurized fluid;

a valve in fluid communication with the pressurized fluid source; and a voice coil actuator comprising a magnet and a conductive coil oriented relative to the magnet such that when current flows through the coil, the coil moves relative to the magnet, wherein the voice coil actuator is coupled to the valve such that the relative movement of the coil causes an adjustment in a flow rate of the pressurized fluid through the valve.

2. The control system of claim 1, wherein the valve comprises:

a valve body having an inlet port, an outlet port, and a passageway extending therethrough and interconnecting the inlet and outlet ports; and a valve member housed within and moveable between first and second positions within the passageway, wherein when the valve member is in the first position, substantially no pressurized fluid flows through the passageway, and when the valve member is in the second position, pressurized fluid flows into the inlet port, through passageway, and out of the outlet port of the valve body.

3. The control system of claim 2, wherein the movement of the coil relative to the magnet causes movement of the valve member between the first and second positions.

4. The control system of claim 3, wherein the movement of the coil relative to the magnet and the movement of the valve member between the first and second directions occur in substantially parallel directions.

5. The control system of claim 4, wherein the coil is arranged substantially symmetrically about an axis, and wherein the axis extends through the valve member.

6. The control system of claim 5, wherein the axis extends through the outlet port of the valve body.

7. The control system of claim 6, wherein the outlet port of the valve body comprises an inner edge, and wherein when the valve member is in the first position, the valve member contacts the inner edge of the outlet port.

8. The control system of claim 1, wherein the voice coil actuator comprises first and second magnets, each have first and second poles, and the first and second magnets are arranged such that the first poles of the first and second magnets are positioned substantially between the second poles of the first and second magnets.

9. The control system of claim 8, wherein the conductive coil comprises a first portion wound in a clockwise direction about an axis and a second portion wound in a counterclockwise direction about the axis.

10. The control system of claim 9, wherein the first and second magnets jointly form a magnet assembly and the conductive coil circumscribes the magnet assembly.

11. A control system for a maneuverable kill vehicle comprising:

a pressurized fluid source configured to provide a pressurized fluid;

a valve in fluid communication with the pressurized fluid source; and a voice coil actuator comprising:

a magnet assembly having first and second magnets, each having first and second poles, and being arranged such that the first poles of the first and second magnets are positioned substantially between the second poles of the first and second magnets; and first and second conductive coil portions oriented relative to the magnet assembly such that when current flows through the coil portions, the coil portions move relative to the magnet assembly, wherein the voice coil is coupled to the valve such that said relative movement of the coil portions causes an adjustment in a flow rate of the pressurized fluid through the valve.

12. The control system of claim 11, wherein the valve comprises:

a valve body having an inlet port, an outlet port, and a passageway extending therethrough and interconnecting the inlet and outlet ports; and a valve member housed within and moveable between first and second positions within the passageway, wherein when the valve member is in the first position, substantially no pressurized fluid flows through the passageway, and when the valve member is in the second position, pressurized fluid flows into the inlet port, through passageway, and out of the outlet port of the valve body and the movement of the coil portions relative to the magnet assembly and the movement of the valve member between the first and second directions occur in substantially parallel directions.

13. The control system of claim 11, wherein the first and second coil portions are arranged substantially symmetrically about an axis, the first coil portion is wound in a first direction about the axis, the second coil portion is wound in a second direction about the axis, and the axis extends through the valve member.

14. The control system of claim 13, wherein the axis extends through the outlet port of the valve body, the outlet port of the valve body comprises an inner edge, and when the valve member is in the first position, the valve member contacts the inner edge of the outlet port.

15. The control system of claim 14, wherein the first and second coil portions circumscribe the magnet assembly and are in a fixed position relative to the valve member.

16. A maneuverable kill vehicle comprising:

a frame;

a pressurized fluid source connected to the frame configured to provide a pressurized fluid;

a plurality of valves in fluid communication with the pressurized fluid source;

a plurality of voice coil actuators, each comprising a magnet and a conductive coil oriented relative to the magnet such that when current flows through the coil, the coil moves relative to the magnet, wherein each of the voice coil actuators is coupled to a respective valve such that the relative movement of the coil causes an adjustment in a flow rate of the pressurized fluid through the respective valve; and a controller in operable communication with the voice coil actuators and configured to selectively cause the current to flow through the coils of the voice coil actuators.

17. The maneuverable kill vehicle of claim 16, wherein each of the valves comprise:

a valve body having an inlet port, an outlet port, and a passageway extending therethrough and interconnecting the inlet and outlet ports; and a valve member housed within and moveable between first and second positions within the passageway, wherein when the valve member is in the first position, substantially no pressurized fluid flows through the passageway, and when the valve member is in the second position, pressurized fluid flows into the inlet port, through passageway, and out of the outlet port of the valve body, and wherein the movement of the coil relative to the magnet causes movement of the valve member between the first and second positions, and the movement of the coil relative to the magnet and the movement of the valve member between the first and second directions occur in substantially parallel directions.

18. The maneuverable kill vehicle of claim 17, wherein the coil of each of the voice coil actuators is arranged substantially symmetrically about an axis, and wherein the axis extends through the valve member and outlet port of the respective valve.

19. The maneuverable kill vehicle of claim 18, wherein when the pressurized fluid flows through each of the plurality of valves, a force is exerted on the frame.

20. The maneuverable kill vehicle of claim 19, further comprises a second plurality of valves in fluid communication with the pressurized fluid source and wherein the second plurality of valves and the pressurized fluid source are configured such that when the pressurized fluid flows through each of the second plurality of valves, a second force is exerted on the frame, the second force being greater than the first force.

* * * * *